US007287553B2

(12) United States Patent
Wahhoud

(10) Patent No.: US 7,287,553 B2
(45) Date of Patent: Oct. 30, 2007

(54) LENO CLOTH AS WELL AS METHOD AND WEAVING MACHINE FOR PRODUCTION THEREOF

(75) Inventor: Adnan Wahhoud, Lindau (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 68 days.

(21) Appl. No.: 11/323,720

(22) Filed: Dec. 29, 2005

(65) Prior Publication Data

US 2006/0169347 A1 Aug. 3, 2006

(30) Foreign Application Priority Data

Dec. 31, 2004 (DE) ..... 10 2004 063 683
Sep. 19, 2005 (DE) ..... 10 2005 044 788

(51) Int. Cl.
*D03C 7/00* (2006.01)
*D03C 11/00* (2006.01)
*D03C 13/00* (2006.01)

(52) U.S. Cl. ..... 139/50; 139/97; 139/101; 139/212; 139/425 R; 139/55.1

(58) Field of Classification Search ..... 139/50, 139/97, 101, 104, 212, 416–419, 420 R, 139/425 R, 426 R, 420 A, 35, 55.1, 383 R
See application file for complete search history.

(56) References Cited

U.S. PATENT DOCUMENTS 4,160,057 A * 7/1979 Kogan et al. ..... 428/193
4,320,160 A * 3/1982 Nishimura et al. ..... 428/107
4,614,210 A * 9/1986 Debaes ..... 139/54
5,123,454 A * 6/1992 Debaes ..... 139/54
5,421,376 A * 6/1995 Sinha ..... 139/419
6,092,559 A * 7/2000 Dvorak et al. ..... 139/50
6,116,291 A 9/2000 Hockemeyer et al.
6,311,737 B2 11/2001 Wahhoud et al.
6,315,008 B2 * 11/2001 Dornier et al. ..... 139/50

(Continued)

FOREIGN PATENT DOCUMENTS

DE 197 50 804 5/1999

(Continued)

*Primary Examiner*—Gary L. Welch
*Assistant Examiner*—Robert H Muromoto
(74) *Attorney, Agent, or Firm*—W. F. Fasse; W. G. Fasse

(57) ABSTRACT

A leno cloth is prepared, which comprises at least ground warp threads 1, leno warp threads 3 and weft threads 2, and in which the weft threads 2 and the ground warp threads 1 are arranged essentially interspace free. The weft threads are bound-off by means of the leno warp threads 3, which comprise a clearly lower titer relative to the ground warp threads 1, with such a lower tension relative to the ground warp threads, so that the crossings of the leno warp threads 3 with the ground warp threads 1 that are present due to the binding are arranged in a plane parallel to the plane of the maximum thickness of the weft threads. The leno warp threads 3 comprise a higher working-in or take-up into the woven cloth than the ground warp threads 1. According to a further aspect of the invention, a method for the production of a leno cloth as well as a loom for the carrying out of the method for the production of a leno cloth are described.

26 Claims, 9 Drawing Sheets

U.S. PATENT DOCUMENTS

| | | | | |
|---|---|---|---|---|
| 6,382,262 | B1 * | 5/2002 | Herzig | 139/50 |
| 6,510,871 | B2 * | 1/2003 | Baumann et al. | 139/50 |
| 7,040,354 | B2 * | 5/2006 | Schwemmlein et al. | 139/430 |
| 2001/0015235 | A1 * | 8/2001 | Dornier et al. | 139/50 |
| 2004/0154680 | A1 * | 8/2004 | Schwemmlein et al. | 139/103 |
| 2005/0173013 | A1 | 8/2005 | Wahhoud et al. | |

FOREIGN PATENT DOCUMENTS

| | | |
|---|---|---|
| DE | 100 04 376 | 8/2001 |
| DE | 101 28 538 | 1/2003 |

* cited by examiner

LENO CLOTH AS WELL AS METHOD AND WEAVING MACHINE FOR PRODUCTION THEREOF

FIELD OF THE INVENTION

The invention relates to a leno cloth as well as a method and a weaving machine or loom for the production of such a leno cloth, such as floor coverings.

BACKGROUND INFORMATION

Leno cloths consisting of ground warp threads, leno warp threads and weft threads are known; similarly methods and looms for the production thereof.

From DE 100 04 376 A1, a method for the production of a leno ground cloth and a loom for carrying it out are known. This method is realized by means of a loom, in which per se known half healds or heddles with lifting healds or heddles according to DE 197 508 04 C1 in combination with at least two heald frames are used as shedding arrangements. In that regard, the production of the leno ground cloth is achieved in that at least two heald frames are equipped with a plurality of first lifting heddles for half heddles, and the other heald frame is equipped with the same plurality of lifting heddles for the half heddles. In the production of such a leno ground cloth, the warp tension of both the so-called standing or stationary thread warp as well as the leno thread warp plays an important role. In this known method, it is provided that the desired or nominal warp tension of the standing or stationary thread warp is approximately twice as large as the desired or nominal warp tension of the leno thread warp. Thereby, a leno cloth with a relatively high resistance to slipping or shifting is achieved. In this known method or in the loom for carrying out the method, it has been recognized as disadvantageous, however, that the service life of the half heddles with the lifting heddles is not sufficient. Moreover it is disadvantageous, that the two shaft frames equipped with the half and lifting heddles in a typical manner require a shed forming machine or shedding machine, which is costly, because the complexity or expenditure of the shedding machine in the loom is relatively independent of the number of the heald frames or shafts.

Moreover, a loom for the production of a leno cloth is known from DE 101 285 38 A1, in which the drive for the shedding arrangements, into which the stationary warp threads and the leno warp threads are pulled, and in which they are guided, is derived from the drive of the loom itself. In this known loom, a so-called leno needle reed and a stationary needle reed are utilized as shedding arrangements. Each needle reed has a plurality of needles, at the free ends of which at least one eye for guiding through the respective leno warp thread or the respective stationary warp thread is provided. The needles of each needle reed are separated by flat rods, in order to ensure that respectively one leno warp thread can jump over only one needle of the stationary reed in the production of the leno binding. In this known loom, the leno and the stationary warp threads are prepared or provided from at least one ground warp beam and are supplied to the shedding arrangements over at least one backrest beam. Therefore, the leno warp threads and the stationary warp threads comprise one and the same warp tension. The variety or diversity of the patterns for such leno cloths is limited in so far as qualitative differences between the leno warp threads and the stationary warp threads, especially relating to the fineness of the warp yarns or the threads, are largely excluded.

According to a further aspect, the invention relates to a leno cloth with novel functional characteristics, especially for use as a floor covering.

Among other things, velour, loop-type or smooth textiles are utilized for floor coverings. Various production methods are known for the production of these floor coverings. Thus it is known to produce velour and loop carpets on complicated and costly velvet and double carpet looms. With regard to the further known so-called tufting carpets and methods for the production thereof, a substrate or carrier layer, for example a fleece or a woven cloth in the form of a pile layer, is introduced, and namely normally through working-in or take-up of yarn loops, whereby the surface can be embodied as velour or in the form of loops. In order to bond or strengthen the worked-in loops, these are subsequently bonded with the substrate or carrier material through a binder agent. That means, that several process stages are necessary for the production of tufting carpets. These production methods are, among other reasons, so complicated or costly, because floor coverings must comprise basically different functional characteristics on the top side and bottom side thereof. Particular demands are made especially on the surface structure, the treading or stepping comfort, and the robustness of the top side. On the bottom side of the floor coverings, above all other things, such characteristics are especially important, which come into play in cooperation with the respective underlying floor or ground. For example, among those are slip resistance, and adhesiveness. Furthermore, certain demands are made on the floor covering overall, such as, for example, a certain stiffness and slipping or shifting resistance as well as a desired surface unit weight.

Woven cloths, especially the leno cloths considered here, which comprise different characteristics on their top side than on their bottom side are also designated as so-called "double face" fabrics or cloths. These different characteristics can, on the one hand, relate to physical characteristics as with the floor coverings, but they can, however, also comprise aesthetic aspects with respect to patterning and color intensity on the front and/or the back side of the cloth.

SUMMARY OF THE INVENTION

Therefore it is the underlying object of the invention to provide a dense leno cloth, which comprises different functional and/or aesthetically effective top and bottom sides, which is easily producible and is accessible to a variety of application fields. Moreover, it is a further object of the invention to provide a method and a loom for the realization of such a method for the production of the inventive leno cloth.

The inventive leno cloth comprises at least ground warp threads, leno warp threads and weft threads, whereby the weft threads are arranged on the ground warp threads essentially free of intermediate space. Free of intermediate space shall be understood to mean that the weft threads are arranged so closely or tightly next to one another that they at least slightly contact each other, so that the side of the leno cloth that is formed by the weft threads is formed essentially by the structure or color thereof. The weft threads are bound-off by means of the leno warp threads, which comprise a clearly smaller titer relative to the ground warp threads, whereby they are bound-off with such a lower tension relative to the ground warp threads, that the crossing points of the leno warp threads with the ground warp threads, which are present as a necessary consequence of the binding, are arranged in a plane, which is different from the plane that extends through the maximum thickness of the weft threads and in the lengthwise direction thereof. That means that the crossing points or intersections are either oriented toward the ground warp threads or are arranged on the top side formed by the weft threads, but not however between the weft threads. In that regard, the leno warp threads comprise a greater working-in insertion or take-up into the woven cloth than the ground warp threads. This means that the weft threads essentially remain in their lengthwise extension without distortion or winding deflection, while the leno warp threads, due to their clearly lower warp tension, loop around the weft threads for the binding-off thereof with the ground warp threads in the sense of a stronger working-in insertion or take-up.

If the leno warp threads, due to tension, are arranged between the ground warp threads and the weft threads, that is to say under or below the maximum weft thread thickness, then the crossing points or intersections are essentially covered by the weft threads that contact each other, so that they are essentially not visible on the top side of the leno cloth formed by the weft threads. Due to the tension-necessitated offsetting of the crossing points to the bottom side of the weft threads, and therewith in the direction toward the ground warp threads, a so-called double-face characteristic of the leno cloth can be achieved with corresponding color or structural adaptation of ground warp threads and leno warp threads to one another. Thus, the color or the structure of the ground warp threads and the leno warp threads dominates on the side of the ground warp threads, whereas the color or the structure of the weft threads dominates on the side of the leno cloth lying opposite thereto, that is to say on the top side thereof.

In that regard, for the woven cloth formation, the leno warp threads are provided from a first warp beam and the ground warp threads are provided from a second warp beam, whereby the leno warp threads are pulled into first shedding arrangements and the ground warp threads are pulled into second shedding arrangements. Both warp thread types are guided or brought together in the binding or interlacing point of the leno cloth to be produced. Because the ground warp threads and the leno warp threads are provided from warp beams with respectively their own electric motor drive, that is to say electric motor warp let-off, the tension of the ground warp threads as well as of the leno warp threads can be individually adjusted and controlled. Therewith it is possible, depending on the adjusted tension, to arrange the intersections or crossing points of the leno warp threads with the ground warp threads, which arise necessitated by the binding, either below a plane extending through the maximum thickness of the weft threads, or above this plane. Thus it is possible, for example, to produce a characteristic leno cloth, in that the ground warp threads consist of significantly coarser warp material than the leno warp threads, whereby the tension of the ground warp threads certainly can amount to the multiple of the tension of the leno warp threads.

Preferably in the leno cloth according to the invention, the weft threads are arranged and bound-off so closely or tightly next to one another that the cloth has a structure that is slip resistant. In that regard, slip resistant structure means an exceptionally tight, close or dense woven cloth, which otherwise at best could be achieved with a plain tabby or linen weave. A significant advantage of such a leno cloth is especially that the structure or patterning or color of at least one side of the leno cloth is determined by the weft threads, which are of course easily insertable as needed into the respective loom shed at the respective location, whereas in a typical conventional woven cloth, the different form or pattering is achieved via the ground warp threads, whereby a relatively great effort arises for different colors with respect to the winding-up of different yarns or different colors onto the warp beams. Thus, the leno cloth according to the invention has an exceptionally great flexibility with respect to the patterning and the structure in comparison to typical conventional leno cloths.

Because the tension of the leno warp threads is clearly lower in comparison to the tension of the ground warp threads, the ground warp threads are only weakly contracted or worked into the cloth, so that they extend essentially linearly and are bound-off or tied up by means of the strongly contracted or worked-in leno warp threads. The weft threads cover the leno warp threads and therewith also the ground warp threads nearly completely. Thereby the color, structure or the surface of the leno cloth is determined on the one side by the weft threads and on the other side by the ground warp threads as well as the leno warp threads, so that thereby a so-called double-face cloth is producible.

Preferably the leno cloth is embodied so that at least one coarse and especially soft weft thread and at least one thin and especially stiff weft thread are arranged alternatingly on the top side of the ground warp threads in such a manner so that the coarse weft threads essentially cover over the thin weft threads and form an essentially closed top surface that is especially defined by the color and structure of the coarse weft threads. The coarse weft threads and the thin weft threads can be arranged alternatingly; it is however also possible, that respectively two coarse weft threads are followed by one thin weft thread, or vice versa, or also other combinations of coarse weft threads and thin weft threads are realized. The order or sequence of the arrangement of coarse weft threads and thin stiff weft threads substantially also contributes to the stiffness of the cloth in the weft direction, besides the stiffness in warp direction achieved by the ground warp threads. The voluminous coarse weft threads cover the finer stiff weft threads toward the top surface, whereby the already mentioned dense or tight, essentially closed top surface is formed. Thus, they thereby ensure that the surface characteristics especially of a floor covering do not change despite increased stiffness of the overall woven cloth.

The weft threads and the ground warp threads are looped around by the leno warp threads, that is to say the leno warp threads extend both horizontally as well as vertically in plural planes and bind the weft threads and the ground warp threads together to form a tight woven cloth. Through a suitable material selection of the individual threads or yarns, the desired different functional characteristics on the top side or on the bottom side of the woven cloth are achieved. If, for example, durable wear-resistant coarse weft threads are utilized, thereby the top side of the woven cloth is embodied as a robust and abrasion resistant surface. Especially for floor coverings, such materials are used as the ground warp threads, so that a slip resistant stiff underlayer of the woven cloth arises.

Because the ground warp threads of the inventive woven cloth are arranged on the bottom side of the woven cloth and extend essentially linearly in one plane, they form a substrate or base plane for the weft threads if they are correspondingly tightly or densely arranged.

A considerable advantage of the inventive leno cloth exists in that, namely through a suitable material selection, the respective structure, the physical characteristics as well as aesthetic forms are easily realizable with the inventive woven cloth for any desired applications through the utilization of corresponding weft threads. Different functional characteristics on the respective size of the woven cloth are, for example, also especially advantageous for awning fabrics. The functional characteristics include especially volume, topography of the surface, final appearance, color and step or walking comfort, as well as surface stability or durability, and similarly the patterning.

In contrast to that, the ground warp threads arranged on the bottom side of the woven cloth take over essentially the function of the stiffness of the woven cloth and of the desired characteristics, such as, for example in the case of a floor covering, the characteristics of the woven cloth in connection with the underlying floor or ground, on which the floor covering is to be laid. Because the ground warp threads extend nearly linearly on the bottom side of the floor covering and also form a certain surface with corresponding density or tightness, these can also completely or partially consist of metallic fibers, whereby a conductivity is achieved, which can find application, for example, for detection tasks such as especially the monitoring of rooms and/or the dissipation of electrostatic charges.

The leno warp thread is utilized as a binding thread and forms the binding element between the weft threads forming the surface and the ground warp threads. Thereby, a tight or dense and slip resistant leno cloth is produced in one working process and with relatively small effort in the production, whereby this leno cloth can especially be excellently utilized as a floor covering.

A further advantage of the inventive leno cloth exists in that, among other things, an article change can easily be realized, because merely the weft yarns and/or the weft density can simply easily be changed. For example, on a gripper loom, up to 16 colors with pick-and-pick bobbin changing can be presented for the weft insertion in the weft. According to a preferred embodiment of the invention, the thickness of the woven cloth is varied or changed and adapted to the respective application through the variation of the fineness or gage of the weft yarn in the range from 20,000 dtex (0.5 Nm) to 500 dtex (20 Nm), for example of natural and synthetic fibers. Furthermore, through a special selection of a certain weft yarn or through use of such a weft yarn, it can easily be achieved that step-shaped contours arise on the top side of the woven cloth, without the contour on the bottom side being changed. For the form of the bottom side is determined exclusively by the ground warp threads. This is desired, for example, for textile floor coverings for achieving certain aesthetic effects. In the inventive leno cloth, the weft density or closeness may also be adjusted, so that the fibers of the weft yarns can be more or less strongly compressed or condensed, and namely depending on the desired utilization characteristic. The characteristic of the binding threads with the corresponding adjustable thread tension during the weaving influence the robustness of the floor covering through the interlacing that arises between weft threads and ground warp threads. The looping or wrapping of the weft threads and the ground warp threads with the binding threads by respectively 180 degrees brings about that a very robust woven cloth with an extremely high slip resistance arises. An extra bonding on the bottom side of the woven cloth, as is necessary for tufting carpets for example, is therefore no longer required for the inventive leno cloths.

The leno warp threads acting as binding threads can be carried out with natural or synthetic fibers with finenesses or gages between 22 and 5,000 dtex, depending on the required robustness and abrasion resistance.

For example, with a yarn fineness of the leno warp threads of, for example, polyester with 22 dtex and the ground warp threads of, for example, polyester with 1,100 dtex, and the weft threads of, for example, polyester with any desired yarn fineness, a woven cloth with leno binding is obtained, in which the ground warp threads stand out prominently in a visually dominating manner on the one side of the woven cloth, while the weft threads stand out predominantly in a visually dominant manner on the other side of the woven cloth. That results especially because the leno warp threads, due to their fineness of 22 dtex are not or barely perceivable in the woven cloth with the naked eye. This is an example of the above already described double-face characteristic of the woven cloth.

According to a further development of the invention, at least two ground warp threads are bound-off together by means of the leno threads. In that regard, the two ground threads form a group of ground warp threads, whereby also at least two weft threads can be bound-off together by means of the leno threads. However, it is also possible that, for example, the individual weft threads the groups of weft threads are bound with at least two leno warp threads.

In order to be able to form step-like structures on the top surface of the leno cloth, preferably the weft threads are varied group-wise with respect to their titer, whereby the number of the weft threads for producing a step-like structure depends on the thickness thereof and the size thereof on the top surface of the woven cloth.

These characteristics of the leno cloth are thus achieved in that groups of ground warp threads are pulled into the shed forming or shedding arrangements of the leno warp threads, and correspondingly oppositely groups of leno warp threads are pulled into the shedding arrangements for the ground warp threads. When using the above mentioned yarn finenesses or gages for the warps and the weft, depending on variation of the weft threads, the entire or overall woven cloth surface or woven cloth sections can be so structured or embodied that these are visually dominant or are visually dominant relative to other woven cloth sections of the ground warp threads. In this manner, for example, leno cloths with lengthwise stripes can be produced. The especially tight or dense woven cloth with slip-resistant structure provides the possibility, for example with multi-colored weft material and single color warp material, to produce a woven cloth in which the colors of the weft threads clearly stand out on only one side of the woven cloth, while on the other cloth side, the cloth bottom side, the ground warp threads are clearly recognizable and therewith the colors of the weft threads are depicted either optically blurred or only unclearly or only weakly.

Woven cloths with these characteristics could previously only be produced with material-consumptive or material-costly satin weaves or twill weaves. Through a corresponding selection of the yarn finenesses for the weft threads and the warp threads, and with suitable adjustment or selection of the tension of the leno warp threads and the ground warp threads, in a leno cloth according to the invention, the already described double-face characteristic is achieved even with very thin and light leno cloths. Preferably, every break or tear resistant type of yarn is useable as ground warp threads. The considerable advantages of the inventive leno cloth with regard to high thread density or tightness and high working-in or take-up of the leno warp threads into the cloth provides the possibility to produce qualitatively high-valued domestic or household textiles as well as technical fabrics.

Preferably, the weft threads comprise a titer of 500 dtex to 20,000 dtex, and the ground warp threads are stiffly embodied. The ground warp threads are preferably at least partially made of metallic material or are metallized and preferably comprise a titer of 500 dtex to 2,000 dtex, whereby the leno warp threads preferably comprise a titer of 15 to 5,000 dtex. In order to allow the leno warp threads optically to recede behind the weft threads, but nonetheless to achieve a reliable binding, the leno warp threads comprise a yarn fineness of 1/30 to 1/60, especially 1/50 of the ground warp threads. Preferably the yarn fineness of the leno warp threads of polyester lies in a range from 15 to 30 dtex and that of the ground warp threads in an order of magnitude of 1,100 dtex.

Because a plurality of materials are utilizable as weft threads, in a preferred embodiment of the invention it is provided to use so-called effect yarns as weft yarns. With these effect yarns, special surface structures and effects are achieved.

According to a second aspect of the invention, a method for the production of a leno cloth as described above is provided. In the method, leno warp threads are supplied as first warp yarn, and ground warp threads are supplied as second warp yarn, from respective warp beams, to the woven cloth. The leno warp threads bind at least respectively one weft thread inserted onto the ground warp threads together with the ground warp threads, whereby the leno warp threads are adjusted to a warp tension that is clearly or significantly lower compared to the ground warp threads, and whereby the leno warp threads are more strongly worked-into or run-into the woven cloth.

Preferably the leno warp threads are pulled individually or group-wise into a first shedding arrangement and the ground warp threads are pulled individually or group-wise into a second shedding arrangement. Through the control or the adjustment or adaptation of the tension of the leno warp threads in comparison to the ground warp threads, it is achieved that the crossing point during the binding-off, depending on the tension relationship, moves into a plane that is different from the plane that extends through the maximum thickness of the weft threads and in the lengthwise direction thereof. That means that the crossing points are located either below or above this plane referenced to the maximum thickness of the weft threads. If the crossing points are located below the mentioned plane, then with a corresponding thickness of the weft threads, under certain circumstances, they would be completely covered by the weft threads. It is however also possible that the crossing points are arranged above the weft threads, whereby a completely different surface structure and therewith a completely different appearance of the surface arises. In this case, the surface structure is defined by the weft threads or by the weft threads and the crossing points formed by the leno warp threads.

According to still a further aspect of the invention, a weaving machine or loom for carrying out the method for the production of an above described cloth is provided. The loom according to the invention comprises a leno warp thread warp beam with a first drive and a ground warp thread warp beam with a second drive. A pivoting or rocking reed for guiding the leno warp threads for forming an upper shed and a stationary or underslung reed for guiding the ground warp threads for forming a lower shed are provided, whereby the pivoting reed is drive-connected with a sley and the stationary reed is drive-connected via a drive transmission with a drive shaft. Moreover, a weft thread insertion apparatus is provided, by means of which the weft threads can be inserted into a loom shed that is formable from the leno warp threads and the ground warp threads. Sensors for the detection of the warp tensions and of the leno warp threads as well as of the ground warp threads are provided. These sensors provide signals (actual values) to an arrangement for the control or adjustment and adaptation of the warp tensions. The controller on its part provides corresponding signals to the drives of the warp beams, on the basis of which the warp tensions are adapted in such a manner, so that the tension of the leno warp threads is considerably smaller than the tension of the ground warp threads, whereby the working-in or run-in of the leno warp threads into the woven cloth is therefore higher, especially considerably higher, than that of the ground warp threads.

By means of the adjustment and control of the tension of the leno warp threads as well as of the ground warp threads, depending on the leno cloth that is to be produced with the inventive loom, it is determined in which plane—with respect to the plane extending through the maximum diameter in the lengthwise axis of the weft threads—crossing points between leno warp threads and ground warp threads, which arise necessarily due to the binding, shall be located. Thereby it is influenced, how much or whether at all, the leno warp threads are visible on the top side of the woven cloth, which is essentially formed by the weft threads, and particularly independent of whether the leno warp threads are already so thin that they are only hardly recognizable with the naked eye anyway. Thus, the crossing points wander out of the woven cloth center toward the bottom or toward the top. Wander-toward-the-bottom means that the crossing points are located below an imaginary plane that extends in the direction of the weft thread lengthwise axis through the maximum diameter region thereof parallel to the ground warp threads. Wander-toward-the-top means that the crossing points are arranged above this plane.

Preferably the sley carries a weaving reed, by means of which the weft thread inserted into the loom shed can be beat-up against the binding or interlacing point of the woven cloth, in a per se known manner.

Preferably in the loom, a winding or take-up arrangement for drawing-off and winding-up the finished cloth is provided, whereby the winding arrangement can comprise an independent drive, by means of which the drawing-off or winding-up speed of the finished cloth, and therewith also the warp tension, is influencible.

In the inventive loom, preferably the first warp thread sheet consisting of a plurality of leno warp threads is pulled into the first shedding arrangement, subsequently through a second shedding arrangement, and thereafter through the weaving reed, whereby the respective warp threads are guided together with a second warp thread sheet in the so-called binding or interlacing point of the woven cloth to be produced.

The second warp thread sheet consisting of a plurality of ground warp threads is guided through the first shedding arrangement, subsequently pulled into a second shedding arrangement, and next guided through the weaving reed as well as guided together with the first warp thread sheet in the binding or interlacing point.

In order that possibly arising warp thread breaks can be signaled, the first and the second warp thread sheet run through a warp stop motion that is arranged between the shedding arrangements and the backrest beams. Tension sensors are provided both in the leno warp thread sheet as well as in the ground warp thread sheet for the separate detection and for the separate influencing or control of the warp tension thereof, which tension sensors supply the measured actual tension via a signal transmission to the loom controller. The tensions are now adjusted or controlled so that the ground warp threads are subjected to a higher tension than the leno warp threads. For this purpose, the finished cloth after the binding point is nearly completely looped around by a rotationally driven cloth drawing roller and then guided over suitable deflecting rollers to a rotationally driven cloth beam by which it is rolled up. The rotationally-driven cloth drawing roller, just like the first and the second warp beam, is in operative connection with a separate electric motor drive, which is similarly connected for the transmission of corresponding signals to the loom controller. Thereby, by means of the tension sensors, the actual warp tension in the respective warp thread sheet is detected and transmitted as an electrical signal to the loom controller. In the loom controller, in connection with an actual-nominal value comparison, the deviation of a prescribed nominal or desired warp tension is determined. For detected deviations from the nominal warp tension, the applicable electric motor drive of the applicable warp beam is controlled in the sense of the increasing and decreasing of the warp tension. The abovementioned first and second shedding arrangements are so-called needle reeds or lamellae reeds, which, just like the drives moving them, among other things, are known from DE 101 28 538 A1. The basic underlying construction and the manner of operation thereof described therein are hereby referenced herein. Also known are arrangements for the insertion of the weft thread into a loom shed formed from the leno warp threads and the ground warp threads. These arrangements involve mechanically driven arrangements such as, for example, band or rod guided weft thread grippers or pneumatic or hydraulic arrangements such as, for example, air or water emitted out of nozzles.

Further advantages and embodiments of the invention are now explained in detail in connection with example embodiments with reference to the accompanying drawings.

DETAILED DESCRIPTION OF PREFERRED EXAMPLE EMBODIMENTS AND OF THE BEST MODE OF THE INVENTION

Figure 1A:
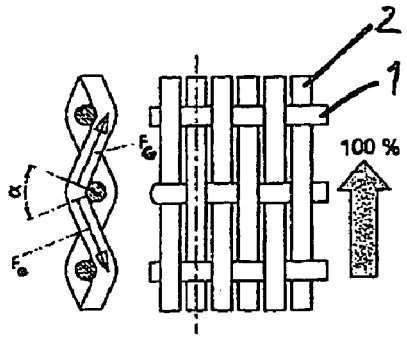
FIG. 1A PRIOR ART
FIG. 1A a woven cloth with conventional linen or plain weave binding with a slip resistance of 100%.
Figure 1B:
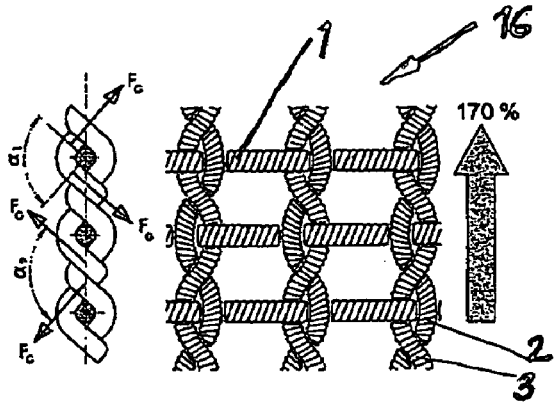
FIG. 1B PRIOR ART
FIG. 1B woven cloth with conventional leno weave binding with a slip resistance increased by 70%.

As a comparison, the shifting or slipping resistance of a traditional linen or plain weave is contrasted to a conventional leno binding in FIG. 1. FIG. 1A shows a traditional linen or plain weave with warp threads 1 and weft threads 2, whereby the side sectional view illustrates the forces which arise along the weft threads around a warp thread. If one assumes a shifting or slipping resistance of 100% for a conventional linen or plain weave according to FIG. 1A, then the shifting or slipping resistance of a conventional leno binding or weave according to FIG. 1B amounts to approximately 170%. The ground warp threads 1 as well as the weft threads 2 and the leno warp threads 3 are illustrated in the top plan view. Thereby it can be seen that sharper angles arise between the forces acting on the ground warp threads, due to the wrapping angle of the weft threads and of the leno warp threads. The latter is shown in the side sectional view. In that regard, the thread tension forces in the woven cloth are illustrated with $F_G$, and the angles between the respective forces are illustrated with $\alpha$ or $\alpha_1$ or $\alpha_2$.

It is thus shown, that textile fabrics with a leno binding are significantly more slip resistant than woven cloths with bindings or weaves such as plain linen, twill, and satin weaves. Characteristic for the slip resistance of woven cloths are the frictional forces that arise due to the crossing of the threads with one another. The slip resistance of a woven cloth with a plain linen weave L 1/1 (see FIG. 1A) is a function of the number of the crossings within one binding unit, the thread tension force in the woven cloth $F_G$, the frictional coefficient $\mu$ between the threads, and the looping or wrapping angle $\alpha$ at the thread crossing.

Now FIG. 1B shows that the slip resistance of a leno cloth is greater due to the higher number of the thread crossings within one binding unit and due to the greater looping or wrapping angle at the thread crossings.

Under the condition of the same thread density, the same thread tension force, and the same frictional coefficient, it arises that the slip resistance of a leno cloth is higher than that of a plain linen weave cloth by a factor of 1.7. The inventive leno cloth now especially makes use of this circumstance. Namely, in the transition from plain linen weave cloths to leno cloths, among other things, the material consumption or use can be reduced by up to 30%, and the productivity of the loom can be increased by 40%. The slip resistance itself can similarly be again increased relative to conventional leno cloths.

Figure 2:
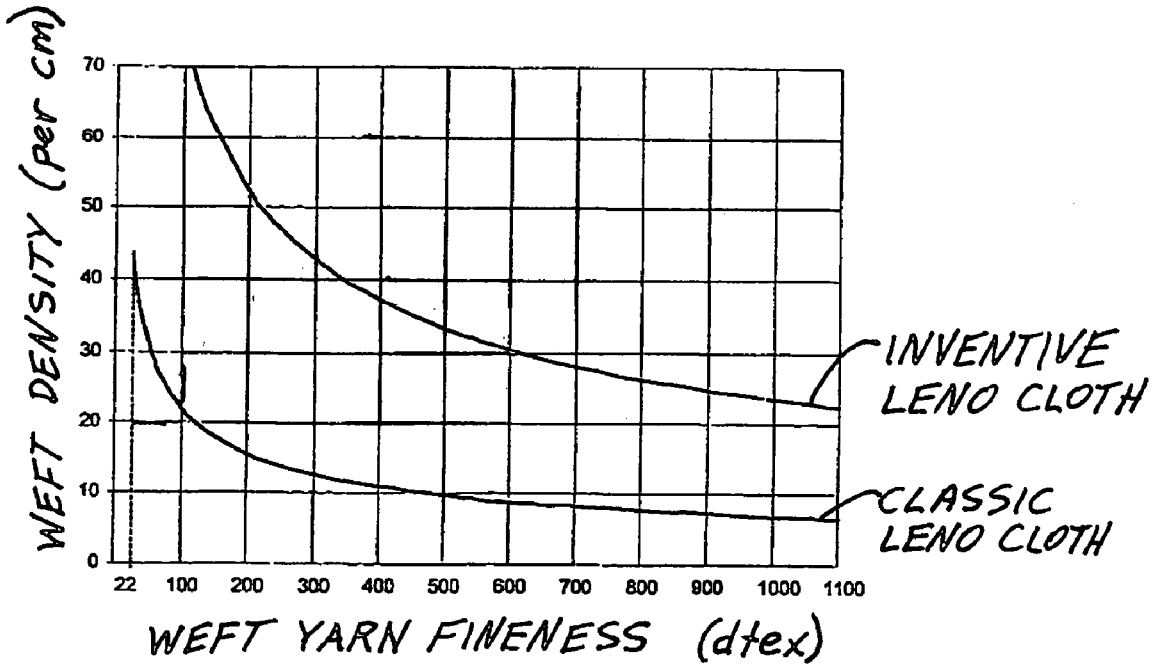
FIG. 2 a diagram for comparing the weft density or closeness in comparison to the fineness of the weft yarn.

FIG. 2 shows a comparison of the weft density of classic leno cloths with leno cloths produced according to the inventive method, with respect to the fineness of the weft yarn. The designation Easy Leno® 2T is also used for the inventive leno cloth. From FIG. 2 it can be seen, that a significantly higher weft density is achievable with the inventive leno cloth relative to classic leno cloths. Among other things, this is due to the fact that the weft threads are arranged nearly linearly on the ground warp threads, and the leno warp threads also have a significantly higher working-in or take-up beside their significantly smaller fineness, so that, due to the linear arrangement of the weft threads, these can be arranged closer or more densely on the ground warp threads. Thereby there arises an extremely dense or tight leno cloth, which additionally has improved aesthetic or color-related or structural characteristics due to the dense or close packing of weft threads next to one another. In the classic leno cloth, the warp threads cross themselves diagonally. This crossing takes up a relatively large volume especially in the warp direction and thus limits the maximum adjustable weft density. Therefore, conventional leno cloths have only been utilized for light, mesh or grid-like or transparent textile fabrics.

The inventive leno cloth or the method for its production operates positively through form-locking in the production of the leno binding. From a technological viewpoint, this means that the warp tension is varied in a much larger extent than previously known.

In the inventive leno cloth, the warp threads are divided in two systems, whereby the inventive leno cloth is achieved through the adjustment of different warp tensions. The crossing of the warp threads no longer occurs—as in the conventional leno cloth—diagonally, and a leno cloth with a new optic appearance is produced, which is substantially influenced by the significantly higher weft density. Moreover it is possible to reproducibly achieve a so-called stretch-stop-effect through the use of an elastane yarn for one of the two warp systems. This effect is very advantageous especially in the production of functional textiles. Completely new types of woven cloth constructions can be produced especially with the substitution of the binding threads through finer threads in comparison to the utilized weft threads. In FIG. 2 it becomes clear that a substantially higher weft density can be achieved with the inventive leno cloth. In that regard, the weft threads can be beat-up so closely or tightly against one another, that a density degree of 100% is achieved. On the top side, the thusly produced leno cloth exhibits a so-called mock or false plain linen weave.

Due to the fact that the weft threads lie linearly in the inventive leno cloth in contrast to the plain linen weaves, the woven cloth contraction or shrinkage and the use of massive temple or expander systems can be avoided. Additionally, the so-called multi-color effects can be introduced in the woven cloth via the weft threads. For example, for awning cloths, the production is significantly simplified in the weaving preparations. This also applies to a considerable extent for the doubling or twisting mill work, warping room work, and sizing room work. Namely, with respect to the weaving technology, it is simpler to vary the color or the yarn type via the weft threads, than to produce warp beams that have the color variations required by the patterns or by the stripes wrapped-up or rolled-up thereon. Especially in the weaving of awning cloths, a strong increase of the flexibility is achieved by the inventive leno cloth.

While a maximum color brilliance of approximately 80% can be achieved for a plain linen weave, a color brilliance of approximately 95% is achieved with the inventive leno cloth. The color effects due to the weft threads are more clear, and a fine character is provided to the woven cloth surface. Moreover, such a fine surface structure is best suited to get a better handle on water and dirt repellency. Moreover, such fine surface structures offer advantages in the application of a woven cloth produced in this manner, with respect to a backing or base cloth for digital printing, as a decating cloth, as well as for napped blankets.

Figure 3:
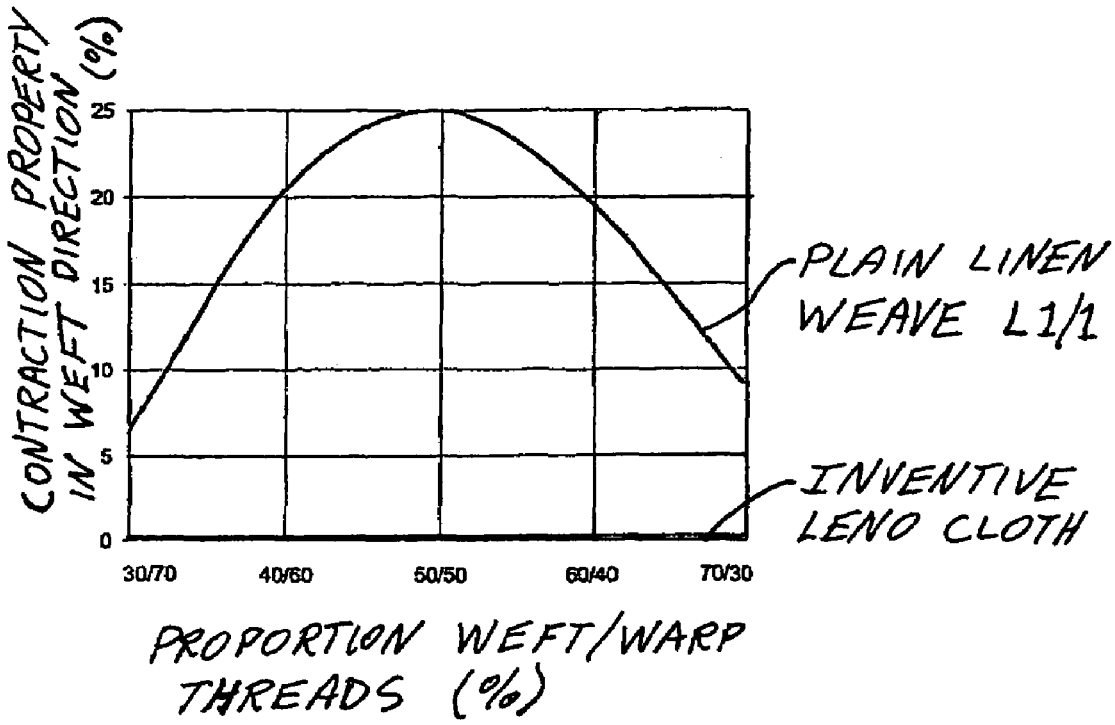
FIG. 3 a comparison of the working-in or run-in for conventional tight linen or plain woven cloth and tight leno woven cloth.

In FIG. 3, the working-in or take-up of a tight or dense plain linen weave cloth is compared with that of a tight or dense leno cloth. From that it is recognizable, that the inventive leno cloth comprises no working-in behavior on the loom. That means that the warp thread density can be held precisely constant over the entire weaving width. This is especially advantageous in the production of technical textiles for composites and semi-finished products.

In the production of woven coating fabrics or cloths, through the use of, for example, PES filament yarns of the fineness 1,100 dtex, grid-like constructions with four threads per centimeter and a tightly beat-up weave with an exceptionally fine surface structure of up to 22 threads per centimeter can be realized with the inventive leno cloth. A further field of application, through the use of aramid filament yarns, is the production of ballistic fabrics, whereby the most varied degrees of density are producible corresponding to the use of different yarn sizes. In order to achieve the high tensile strength and the low elasticity of the aramid filament yarns, the molecular chains are oriented through the production to nearly 100% in the tension direction. Since the weft threads can be laid nearly linearly onto the ground warp threads, the inventive leno cloth makes it possible to orient the aramid filament threads also to 100% in the loading direction. Thereby, the characteristics of the expensive aramid yarns can be utilized up to 100% in the woven cloth. Due to the fact that the weft threads of the woven cloth in the inventive leno cloth lie and contact on the warp threads on one side, and are bounded by the ground warp threads on the bottom woven cloth side, weft threads of various different fineness achieve relief-like woven cloth surface structures. The use of elastane yarns in the ground warp thereby decisively supports the deformability of the leno cloth. Such characteristics play a big role above all things for automobile cushions for achieving the requirements or demands desired in that regard, such as deformability and relief structures for air circulation and seating comfort.

FIG. 3 shows that the working-in or take-up in the weft direction is maximal when a woven cloth has 50% weft thread and 50% warp thread proportions. It amounts to approximately 25% and requires fabric spreader or expander rods on the weaving loom for the spreading or expanding of the woven cloth. In order to reduce the contraction or shrinkage in the weaving, one reduces the weft thread proportion and correspondingly increases the warp thread proportion. Thereby, the woven cloth shrinks or contracts less on the weaving loom, and merely two needle wheels in the selvage or auxiliary selvage area are sufficient for the spreading.

If, however, a stripe-like, varyingly-dense woven cloth is to be produced, the working-in or take-up in the weft direction on the weaving loom for a plain linen weave, twill weave and satin weave, will continuously change. This, however, leads to folds in the woven cloth, which is principally always disadvantageous.

In contrast, the inventive leno cloth has, and in fact independently of the thread density, no working-in or take-up behavior in the weft direction. For all density adjustments, expander or spreader cylinders with two needle wheels are sufficient for the cloth guidance, whereby the needle wheels are utilized in the selvage or auxiliary selvage area, whereby principally no folds arise due to weft density changes.

Figure 4:
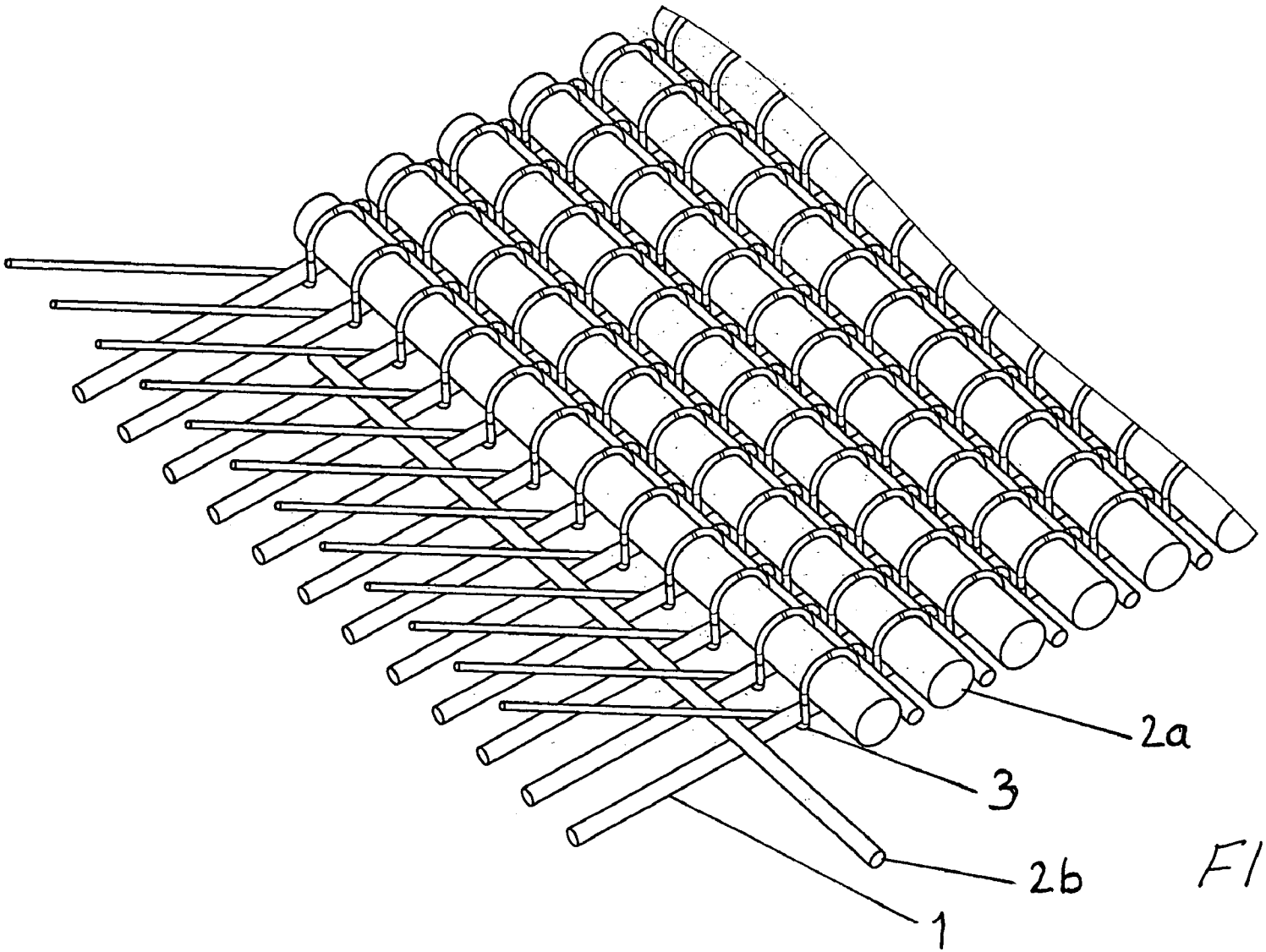
FIG. 4 a leno cloth according to the invention with alternatingly arranged different weft thread materials.

In FIG. 4, a further example embodiment according to the invention is illustrated. In this leno cloth, relatively thick, bulky or voluminous weft yarns 2 are arranged on relatively thin stiff ground warp threads 1. One thin stiff weft thread (2*b*) is positioned between two neighboring weft threads 2*a*, respectively. The weft threads are respectively connected or bound with the ground warp threads 1 by leno warp threads 3. Because the thick weft threads are relatively bulky or voluminous, the thin weft threads are nearly covered by the thick bulky weft threads. Since the leno warp threads comprise a clearly smaller thread size than the thick bulky weft yarns, the top side of the woven cloth is dominated by essentially only the color or structure of the weft threads 2. The thin stiff weft threads 2*b*, together with the ground warp threads 1, serve for the stiffness of the leno cloth on its bottom side. Such a construction is especially advantageous for floor coverings. Namely, therewith a solidified or densified soft surface structure desired in that regard can best be achieved. The stability of such velour-like woven cloth surfaces is comparable to the hand knotting. An additional backing or bonding on the bottom side will no longer be necessary, because the thin stiff weft threads 2*b* provide this additional strength or stability in connection with the ground warp threads 1. Thereby it is possible to conceive light, and also environmentally friendly floor coverings.

Figure 5A:
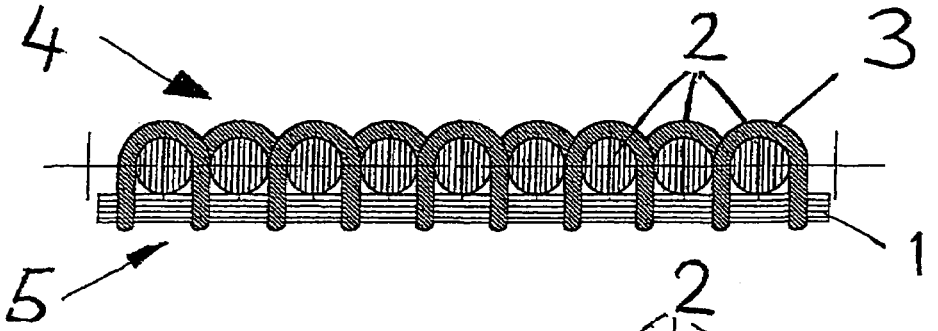
FIG. 5A a schematic illustration of a leno cloth in a sectional illustration.
Figure 5B:
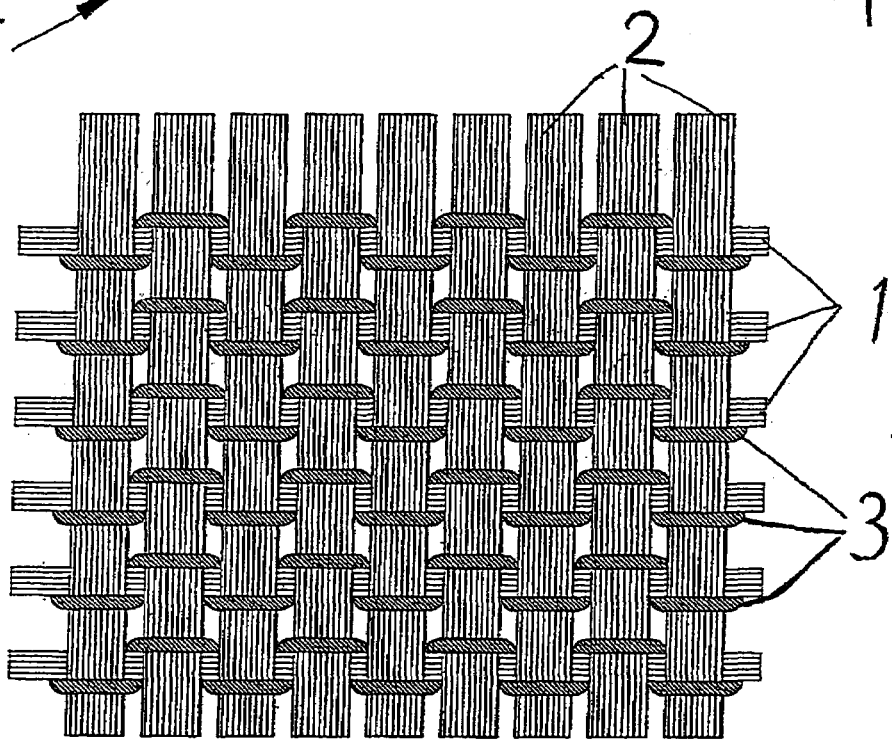
FIG. 5B the schematic illustration according to FIG. 5A in a top plan view.

A side sectional view of a leno cloth is illustrated in FIG. 5A and a corresponding top plan view of the leno cloth is illustrated in FIG. 5B. The ground warp threads 1 extend linearly in the weaving direction, and the weft threads 2 arranged perpendicularly thereto similarly extend linearly. Therebetween, the leno warp threads 3 wrap or loop around the ground warp threads 1 and the weft threads 2 in alternating sequence. The figures are not to scale, namely especially the fineness of the leno warp threads 3 or binding threads can still be considerably smaller than quantitatively shown in FIG. 5. The thinner the leno warp threads 3 are, the more likely it is possible that the weft threads can be arranged lying against one another free of any interspace, whereby they form a tight or dense essentially closed surface.

Also, the spacing distances between the individual ground warp threads 1 can be clearly smaller or even essentially totally disappear, whereby also a tight or dense cloth bottom side arises, which represents a supporting or contact surface. Thereby, the individual weft threads 2 can be arranged so close to one another that they form a very tight or dense layer on the top side of the woven cloth, whereby only the characteristics of the weft threads 2 determine the surface characteristics of the finished woven cloth.

This pertains analogously for the ground warp threads 1. With correspondingly thin thread sizes of the leno warp threads 3 or binding threads, the ground warp threads 1 are arranged so close against one another, that these form a tight or dense layer on the bottom side 5 of the woven cloth. Thereby, the characteristics of the bottom side 5 of the floor covering can be advantageously influenced through the selection of the fineness and of the material of the ground warp threads 1.

Figure 6A:
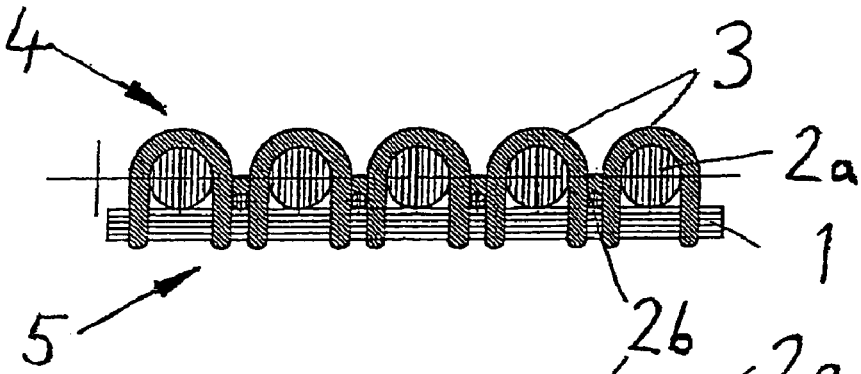
FIG. 6A a schematic illustration of the inventive leno cloth according to FIG. 4 in a sectional illustration.
Figure 6B:
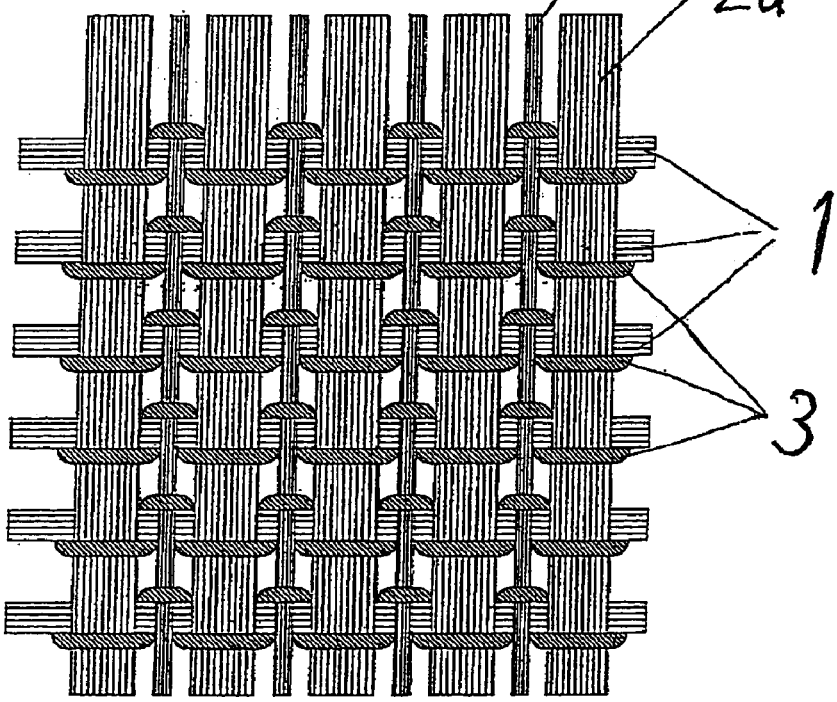
FIG. 6B a schematic illustration of the inventive leno cloth according to FIG. 6A in a top plan view.

A sectional view of the inventive leno cloth illustrated in FIG. 4 is illustrated in FIG. 6A. A corresponding top plan view is shown in FIG. 6B. This illustration is also not to scale, so that the explanations or description in connection with FIG. 5 with respect to the thread sizes and the size of the interspaces are similarly applicable. The interspaces illustrated in FIG. 6 are only illustrated for the better understanding. Namely in the inventive leno cloth, the weft threads can be arranged so tightly or close against one another that these interspaces do not exist. At least with use of coarse and bulky weft threads 2*a*, the arrangement is such that these lie respectively tightly against one another. In contrast to a leno cloth according to FIG. 5, in a leno cloth according to FIG. 6 different weft thread types are used in alternating sequence on the ground warp threads 1. Thereby, a coarse weft thread 2*a* is always followed by a thin weft thread 2*b*. The thin weft thread 2*b* can differ from the coarse weft thread 2*a* also with respect to the material besides the fineness and form. For a textile floor covering, the thin weft thread 2*b* for example consists of a very stiff material and thereby brings about a high stiffness of the leno cloth in the weft direction. On the other hand, in order that the stiff material of the thin weft threads 2*b* does not have a negative influence on the walking comfort of the textile floor covering, the coarse weft threads 2*a* consist of a soft material and are so tightly or closely interwoven with the thin weft threads 2*b* that they completely cover the thin weft threads 2*b*. Thereby, the stiff thin weft threads 2*b* are not visible and also not detectible on the top side 4 of the woven cloth.

Figure 7A:
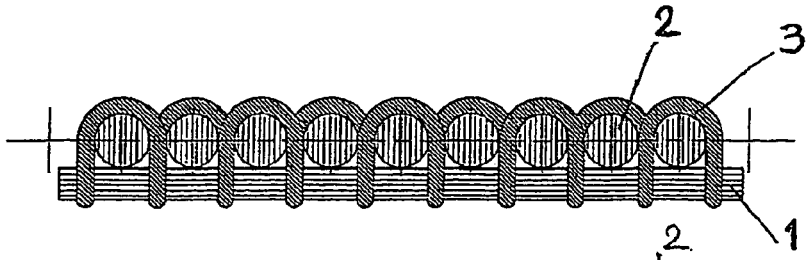
FIG. 7A a schematic illustration of a further example embodiment of the inventive leno cloth in sectional illustration with closely or tightly arranged weft threads.
Figure 7B:
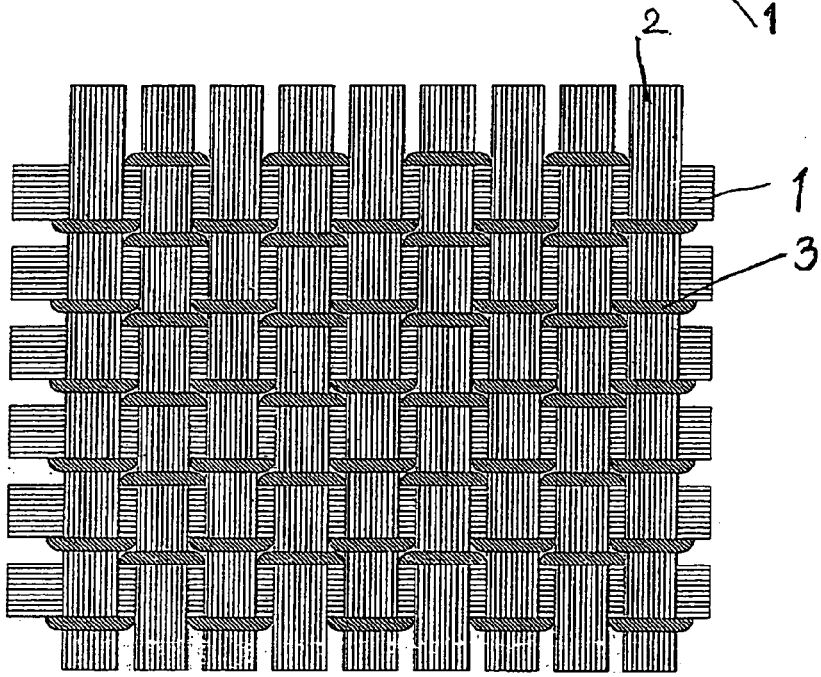
FIG. 7B a schematic illustration of the inventive leno cloth according FIG. 7A in a top plan view with high weft density and high working-in or run-in of the leno warp threads.

FIG. 7 now shows a tight or dense leno cloth, both in a sectional view according to FIG. 7A as well as according to a top plan view according to FIG. 7B, in which leno cloth the weft threads are arranged so tightly or closely against one another as permitted by the thickness of the leno warp threads. When the leno warp threads 3 are selected very thin, the weft threads 2 can be arranged directly tightly next to one another. With a corresponding thickness of the leno warp threads, these may, however, contribute to the feature that the interspaces are filled-out, whereby similarly a tight or dense leno cloth arises.

Figure 8:
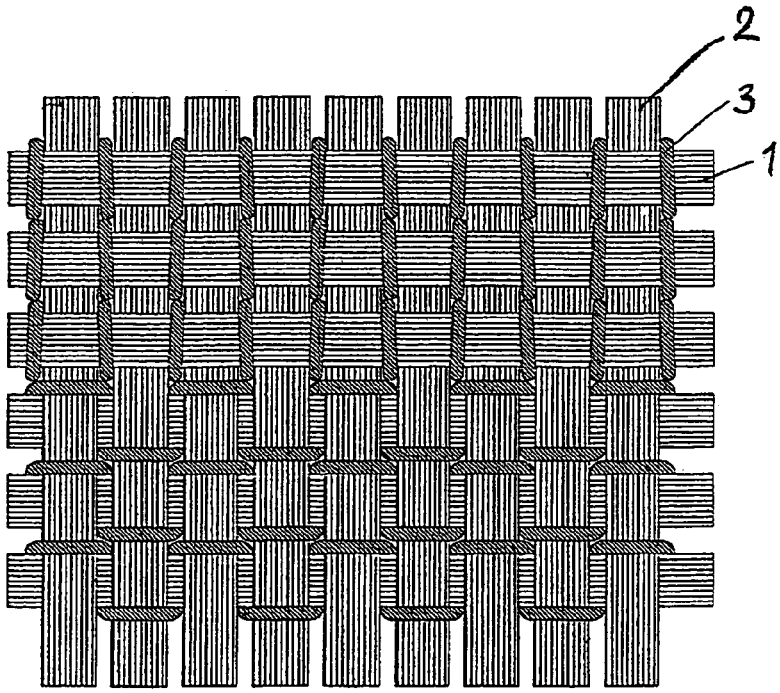
FIG. 8 a further example embodiment of the inventive leno cloth in schematic illustration of the top plan view with group-wise binding-off of the weft threads in ground warp thread direction as well as in weft thread direction.

A similarly produced leno cloth as in FIG. 7 is illustrated in FIG. 8, whereby the direction of the binding-off of the leno threads varies group-wise, so that stripe-type patterns can also be produced via the direction of the binding or tying-off of the leno warp threads 3 with the weft threads and/or the ground warp threads.

Figure 9:
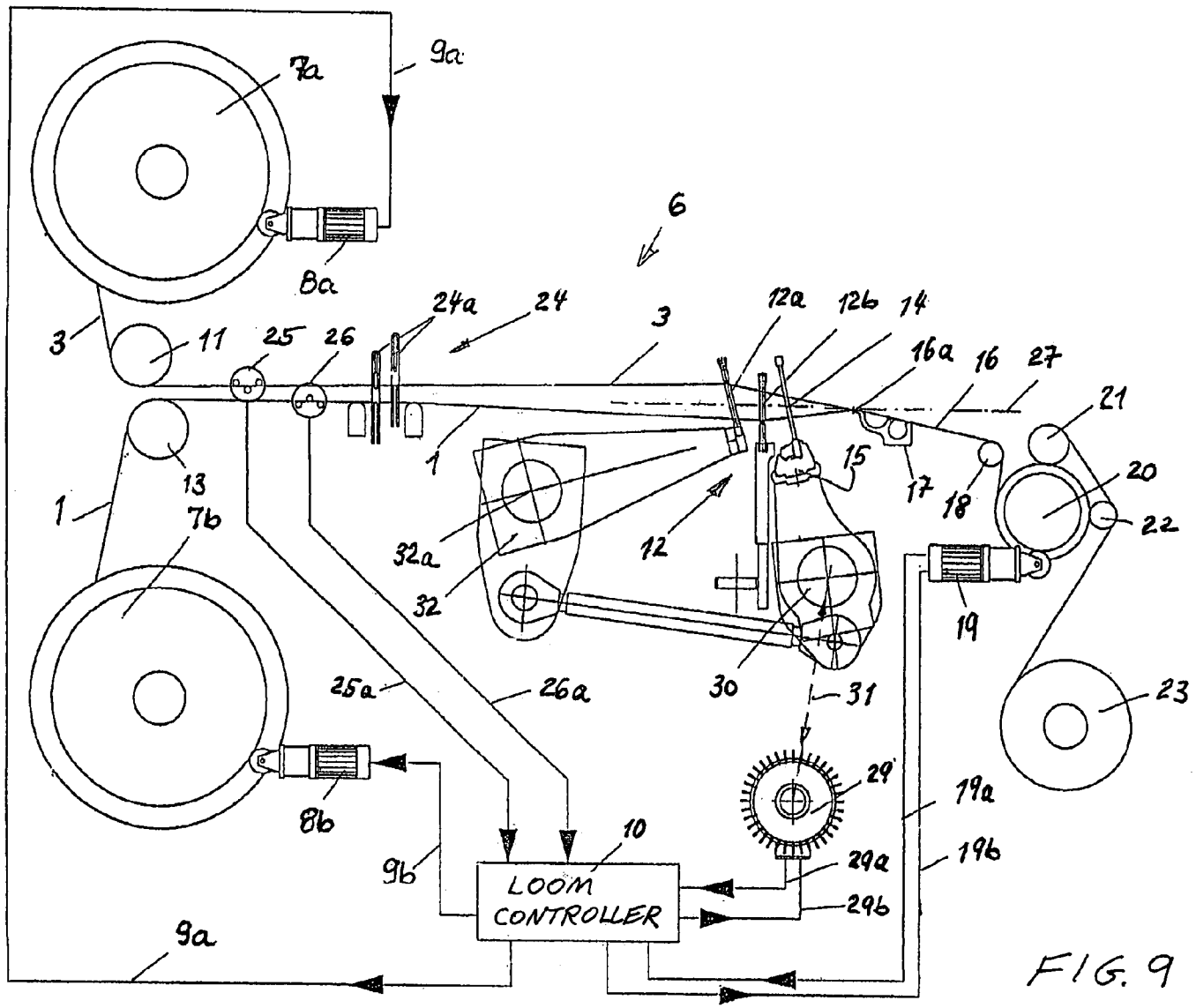
FIG. 9 a schematic illustration of a loom for carrying out the method as a side view.

The weaving machine or loom 6 illustrated schematically in FIG. 9 comprises a first warp beam 7*a* with leno warp threads 3 and a second warp beam 7*b* with ground warp threads 1. The first warp beam 7*a* comprises an electric motorized warp let-off or drive 8*a*, while the second warp beam 7*b* comprises an electric motorized warp let-off or drive 8*b*. Both warp let-off motors or drives 8*a*, 8*b* are connected in a signal transmitting manner via respective control lines 9*a* or 9*b* with a loom controller 10. While the leno warp threads 3 run over a backrest beam 11 arranged axis-parallel to the first warp beam 7*a* in the direction of the shedding arrangements 12, the ground warp threads 1 are guided over another backrest beam 13 arranged axis-parallel to the second warp beam 7*b* in the direction toward the shedding arrangement 12. The shedding arrangement 12, as described in DE 101 28 538 A1, comprises a first needle or lamellae reed 12*a*, into the needles of which the leno warp threads 3 are pulled, and a second needle or lamellae reed 12*b* into the needles of which the ground warp threads 1 are pulled.

Thereafter, the leno warp threads and the ground warp threads 3, 1 run through a weaving reed 14 that is secured on a sley 15. Finally, the leno warp threads and the ground warp threads 3, 1 are guided together in an interlacing point 16*a* of the leno cloth 16 and form the finished leno cloth 16 together with a weft thread that is not shown here and that is beat-up against the interlacing point 16*a* by the reed 14, and which is bound-off by the leno warp threads and ground warp threads.

The finished leno cloth 16 is delivered successively over a stationary cloth support table 17, a deflecting roller 18, and a drawing-in roller 20 provided with a separate electric motor drive 19, from which drawing-in roller 20 it passes through a pinch point or nip between the drawing-in roller 20 and a counter-pressing roller 21, over a further deflecting roller 22, to a cloth beam 23, on which it is wrapped or rolled-up. The described rollers are rotatably supported in a machine frame that is not illustrated here, which also carries the cloth support table 17.

In the area between the backrest beams 11, 13 and the shedding arrangements 12, the leno warp threads and the ground warp threads 3, 1 run through a warp stop motion 24, of which the lamellae 24*a* riding on the warp threads 3, 1 can detect a warp thread break. Between the corresponding backrest beam 11, 13 and the warp stop motion 24, a warp tension sensor 25, 26 is respectively arranged in the leno thread warp and the ground thread warp 3, 1. Both warp tension sensors 25, 26 are respectively connected in a signal transmitting manner via a corresponding signal line 25*a* or 26*a* with the loom controller 10. Also the drawing-in roller 20 comprises a separate electric motor drive 19, which is similarly connected in a signal-transmitting manner via signal lines 19*a* and 19*b* with the loom controller 10. Due to the fact that the drawing-in roller 20 as well as the warp beams 7*a* and 7*b* comprise their own drives, and the rotational speed of the respective beams or roller is controllable via these drives, the tension of the leno warp threads as well as of the ground warp threads can be adjusted via the present system for the control or regulation of the warp tension. This is achieved by means of corresponding nominal-actual-value comparisons, by which the prescribed nominal warp tension in the leno thread warp and in the ground thread warp 3, 1 is maintained or adaptively controlled or adjusted to the respective conditions.

Figure 10:
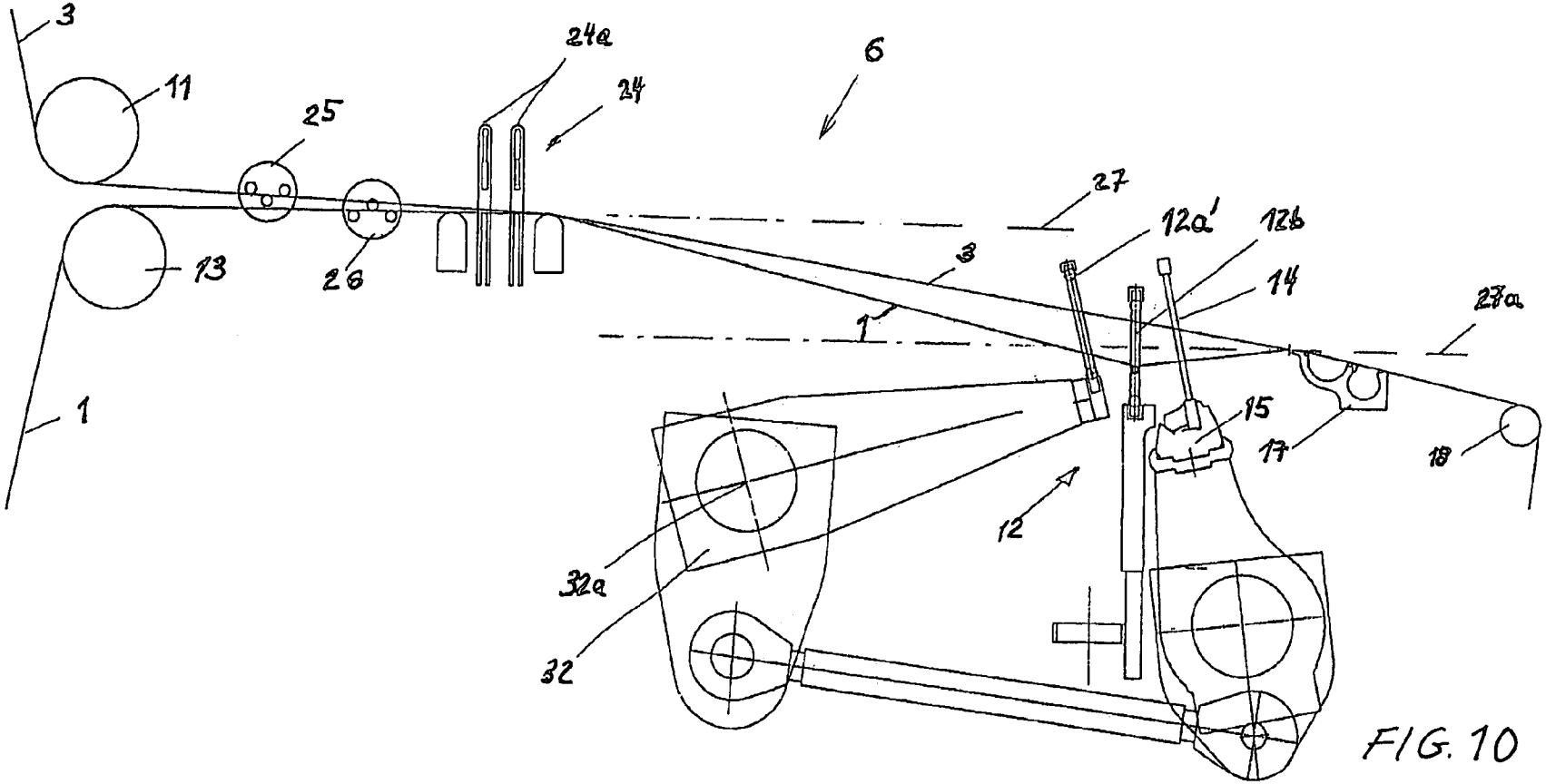
FIG. 10 a schematic illustration of the loom for carrying out the method in side view with needle reed as shedding arrangement for the ground warp threads.

The principal construction and the manner of operation of the shedding arrangements inclusive of the drives thereof are described in the DE 101 28 538 A1, and are hereby referenced. In contrast to FIG. 9, FIG. 10 illustrates a possibility, which allows the use of only one needle reed in the shedding arrangements 12, with a vertical offset or shifting of the weaving plane 27 according to FIG. 9. This vertical offset or shifting of the shedding arrangements 12, of the reed 14 with the sley 15, as well as of the cloth support table 17 out of the original weaving plane 27 into the weaving plane 27*a* is shown in FIG. 10. In this case, it suffices if a standing or stationary needle reed 12*b* for the formation of a lower shed is provided simply or only for the ground warp threads 1. It is also sufficient if the leno needle reed 12*a* is a conventional lamellae reed for the lifting-out of the leno warp threads 3 for the formation of an upper shed, because the motion of the leno warp threads 3 out of the upper shed into the lower shed can be effectuated with the upper reed band or tie 12*a*' of the lamellae reed 24*a*. The return guiding of the leno warp threads 3 out of the lower shed into the upper shed, is, in contrast, effectuated due to the warp tension prevailing in the leno warp threads 3.

Figure 11:
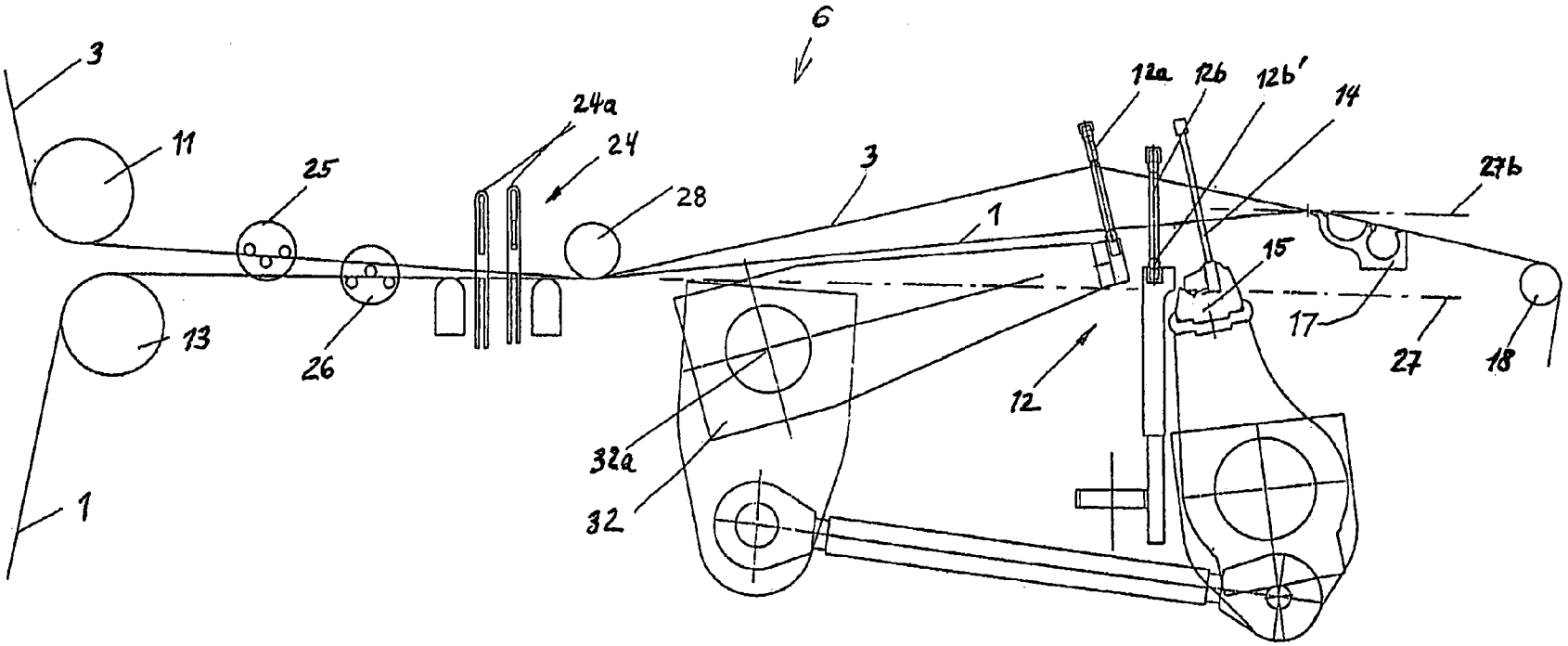
FIG. 11 a schematic illustration of the loom for carrying out the method in side view with needle reed as shedding arrangement for the leno warp threads.

The vertical offset or shifting of the shedding arrangement 12, the reed 14 with the sley 15 as well as the cloth support table 17 out of the original weaving plane 27 into the weaving plane 27*b* is illustrated in FIG. 11. A hold-down device 28 that holds the leno warp threads and the ground warp threads 3, 1 approximately in the arrangement plane of the warp stop motion 24 is provided for the warp stop motion 24 in the direction of the shedding arrangements 12. Due to this, it is sufficient when a leno needle reed 12*a* for the formation of an upper shed is provided simply or only for the leno warp threads 3. It is also adequate, when the standing or stationary reed 12*b* is a conventional lamellae reed for the lowering of the leno warp threads 3 for the formation of a lower shed, because the ground warp threads 1 can be supported in the lower reed band or tie 12*b*' of the standing or stationary reed 12*b* for the formation of an upper shed after the loom shed change of the leno warp threads 3.

It is added that the weaving machines or looms schematically illustrated in the FIGS. 9, 10 and 11 have a main drive shaft which is operatively connected with an electric motor drive 29, and from which is derived the drive for the reed 14, the needle or lamellae reed 12*a* and the needle or lamellae reed 12*b*, with intermediate connection of corresponding transmissions. The drive connection between the drive motor 29 and the reed shaft 30 is symbolically indicated by the double arrow 31. It should be understood, that the drive 29 is connected in a signal-transmitting manner with the loom controller 10 via corresponding signal lines 29*a*, 29*b*.

REFERENCE CHARACTER LIST

1 ground warp threads
2 weft thread
2*a* thick soft weft threads
2*b* thin stiff weft threads
3 leno warp threads
4 top side
5 bottom side
6 weaving machine or loom
7*a,b* warp beam
8*a,b* warp let-off motor
9*a,b* signal line
10 loom controller
11 backrest beam
12 shedding arrangement
12*a,b* needle reed/lamellae reed
12*a',b*' reed band or tie
13 backrest beam
14 weaving reed
15 sley
16 leno cloth
16*a* interlacing point
17 cloth support table
18 deflecting roller
19 drive
19*a,b* signal line
20 cloth drawing-in roller
21 deflecting roller
22 deflecting roller
23 cloth beam
24 warp stop motion
24*a* lamellae reed
25 warp tension sensor
25*a* signal line
26 warp tension sensor
26*a* signal line
27 weaving plane
27*a* weaving plane
27*b* weaving plane
28 hold-down device
29 drive
29*a,b* signal line
30 reed shaft
31 double arrow

The invention claimed is:

1. A leno cloth comprising at least ground warp threads (1) having a first titer, leno warp threads (3) having a second titer smaller than said first titer, and weft threads (2) positioned on said ground warp threads (1), said weft threads (2) having a thickness which defines a first center plane, said leno warp threads (3) binding said weft threads (2) to said ground warp threads (1) with a tension that is smaller than a given tension of said ground warp threads (1), said binding forming crossings of said leno warp threads (3) around said ground warp threads (1), said crossings being positioned in a second plane extending in parallel to said first center plane, and wherein said leno warp threads (3) have a higher take-up into said leno cloth than said ground warp threads (1).

2. The leno cloth of claim 1, wherein said weft threads (2) are arranged and tied so closely next to each other, that the cloth forms a slip-resistant structure.

3. The leno cloth of claim 1, wherein said ground warp threads (1) are tied into the cloth by said leno warp threads (3) with such a low tension that said ground warp threads (3) extend essentially linearly, and wherein said ground warp threads (1) are nearly completely covered by said weft threads (2).

4. The leno cloth of claim 1, wherein said cloth has a first bottom surface next to said ground warp threads (1) and a second top surface opposite said first surface, said weft threads (2) defining said second top surface facing away from said ground warp threads (1).

5. The leno cloth of claim 4, wherein said weft threads (2) have a color and texture which defines said second top surface.

6. The leno cloth of claim 1, wherein said weft threads (2) comprise first thicker weft threads (2*a*) having a given thickness and second thinner weft threads (2*b*) having a thickness thinner than said given thickness, said first thicker and second thinner weft threads being arranged alternately on a top side of said ground warp threads (1) in such a manner, that said first thicker weft threads (2*a*) substantially cover said second thinner weft threads (2*b*), whereby said first weft threads (2*a*) form an essentially closed top surface (4).

7. The leno cloth of claim 6, wherein said first thicker weft threads (2*a*) are coarse and soft and wherein said second thinner weft threads (2*b*) are stiff.

8. The leno cloth of claim 6, wherein said first thicker weft threads (2*a*) have a color and structure which define said essentially closed top surface (4).

9. The leno cloth of claim 1, wherein at least two ground warp threads (1) are tied up together by said leno warp threads (3).

10. The leno cloth of claim 1, wherein at least two weft threads (2) are tied up together by said leno warp threads (3).

11. The leno cloth of claim 1, wherein at least one weft thread of said weft threads (2) is tied up by at least two of said leno warp threads (3).

12. The leno cloth of claim 1, wherein said weft threads (2) are arranged in groups and vary group-wise with respect to their titer in such a manner that step-like structures are formed on a top surface (4) of said cloth.

13. The leno cloth of claim 1, wherein said weft threads (2) comprise a titer of 500 dtex to 20,000 dtex, wherein said ground warp threads (1) comprise a titer of 500 dtex to 2,000 dtex, and wherein said leno warp threads (3) comprise a titer of 15 to 5,000 dtex.

14. The leno cloth of claim 13, wherein said ground warp threads (1) are stiff and are made at least partially of any one of a metallic material and a metallized material.

15. The leno cloth of claim 1, wherein said ground warp threads (1) have a given yarn fineness, and wherein said leno warp threads (3) comprise a yarn fineness of 1/30 to 1/60 of said given fineness of said ground warp threads (1).

16. The leno cloth of claim 15, wherein said leno warp threads (3) comprise a yarn fineness of polyester 15 to 30 dtex and wherein said given yarn fineness of said ground warp threads (1) is a yarn fineness of polyester of 1,100 dtex.

17. The leno cloth of claim 1, wherein said ground warp threads (1) comprise such a titer and are arranged closely to each other so that said ground warp threads (1) form a cloth bottom side (5) having a first structure, and wherein said weft threads (2) comprise such a titer that said weft threads (2) form a cloth top surface (4) having a second structure, whereby said first and said second structures form said cloth as a double-faced cloth.

18. The leno cloth of claim 1, wherein effect yarns are utilizable as said weft threads (2).

19. A method for producing a leno cloth having tie-up crossings in a plane extending parallel to a plane defined by centers of weft threads in said leno cloth, said method comprising the following steps:

a) providing a first warp beam (7*a*) for supplying leno warp threads (3) to an interlacing point (16*a*), b) providing a second warp beam (7*b*) for supplying ground warp threads (1) to said interlacing point (16*a*), c) positioning said weft threads (2) onto said ground warp threads (1), d) tying-up said weft threads (2) and said ground warp threads (1) with said leno warp threads (3) to form crossings and e) feeding said leno warp threads (3) with a lower warp tension than a warp tension of said ground warp threads (1) to said interlacing point (16*a*) so that said leno warp threads (3) have a larger take-up into or higher volume in said leno cloth than said ground warp threads (1).

20. The method of claim 19, further comprising pulling said leno warp threads (3) individually into a first shed, and pulling said ground warp threads (1) individually into a second shed.

21. The method of claim 19, further comprising pulling said leno warp threads (3) in groups into a first shed, and pulling said ground warp threads in groups into a second shed.

22. A loom for producing a leno cloth having tie-up crossings in a plane extending parallel to a plane defined by centers of weft threads in said leno cloth, said loom comprising a) a first warp beam (7*a*) with a first drive (8*a*) for supplying leno warp threads (3), and a second warp beam (7*b*) with a second drive (8*b*) for supplying ground warp threads (1), b) a rocking reed (12*a*) for guiding said leno warp threads (3) for the formation of an upper shed, and a standing reed (12*b*) for guiding said ground warp threads (1) for the formation of a lower shed, c) a sley (15) drive-connected to said rocking reed (12*a*), and a transmission with a drive shaft drive-connected to said standing reed (12*b*), d) a weft thread insertion apparatus for inserting said weft threads (2) into a loom shed formed by said upper shed of said leno warp threads (3) and by said lower shed of said ground warp threads (1), e) warp tension sensors (4, 26) for detecting warp tensions of said leno warp threads (3) and of said ground warp threads (1), and f) an arrangement responsive to said warp tension sensors (4, 26) for adjusting the warp tensions in such a manner that a leno warp thread tension is considerably lower than a ground warp thread tension and so that said leno warp threads have a higher take-up into or volume in said leno cloth (16) than said ground warp threads (1).

23. The loom of claim 22, further comprising a loom controller (10) and wherein said warp tension sensors (4, 26) are connected in a signal-transmitting manner with said first drive (8*a*) and with said second drive (8*b*) through said loom controller (10).

24. The loom of claim 23, wherein said controller (10) adjusts said warp tension of said leno warp threads (3) 50 that a crossing of said leno warp threads (3) with said ground warp threads (1) wanders out of a cloth center in any one of two directions toward a bottom surface and toward a top surface of said leno cloth.

25. The loom of claim 22, wherein said sley (15) carries a reed (14) for beating-up said weft thread inserted into said loom shed against an interlacing point (16*a*) of said leno cloth (16).

26. The loom of claim 22, further comprising a winding-up arrangement for drawing-off and winding-up said leno cloth (16) when said leno cloth is finished.

* * * * *

UNITED STATES PATENT AND TRADEMARK OFFICE

CERTIFICATE OF CORRECTION

PATENT NO. : 7,287,553 B2
APPLICATION NO. : 11/323720
DATED : October 30, 2007
INVENTOR(S) : Wahhoud It is certified that error appears in the above-identified patent and that said Letters Patent is hereby corrected as shown below:

Column 5,
Line 30, after "simply", insert --and--;

Column 6,
Line 18, after "threads", insert --or--;

Column 9,
Line 18, replace "abovementioned" by --above mentioned--;
Following line 30 insert --BRIEF DESCRIPTION OF THE DRAWINGS--;
Line 35, delete "BRIEF DESCRIPTION OF THE DRAWINGS";

Column 18,
Line 59, after "sensors", replace "(4, 26)" by --(25, 26)--;
Line 63, before "for adjusting", replace "(4, 26)" by --(25, 26)--;

Column 19,
Line 2, after "sensors", replace "(4, 26)" by --(25, 26)--;
Line 7, after "(3)", replace "50" by --so--.

Signed and Sealed this

Twenty-fourth Day of February, 2009

JOHN DOLL
*Acting Director of the United States Patent and Trademark Office*